US006120715A

United States Patent [19]

Weigend

[11] Patent Number: 6,120,715

[45] Date of Patent: Sep. 19, 2000

[54] METHOD AND APPARATUS FOR SPINNING, DRAWING, AND WINDING A YARN

[75] Inventor: Helmut Weigend, Radevormwald, Germany

[73] Assignee: Barmag AG, Remscheid, Germany

[21] Appl. No.: 09/261,797

[22] Filed: Mar. 3, 1999

[30] Foreign Application Priority Data

Mar. 5, 1998 [DE] Germany ..... 198 09 381

[51] Int. Cl.[7] ..... D01D 5/098; D01D 5/16; D02G 3/00

[52] U.S. Cl. ..... 264/103; 28/103; 28/245; 28/271; 264/210.8; 264/211.17; 425/66; 425/377; 425/378.2; 425/382.2

[58] Field of Search ..... 264/103, 210.8, 264/211.17; 425/66, 377, 378.2, 382.2; 28/103, 245, 271

[56] References Cited

U.S. PATENT DOCUMENTS 3,636,601 1/1972 Barlow et al. ..... 28/274
4,228,120 10/1980 Bromley et al. .
4,410,473 10/1983 Iohara et al. ..... 264/103

FOREIGN PATENT DOCUMENTS 31 46 054 8/1982 Germany .

*Primary Examiner*—Leo B. Tentoni
*Attorney, Agent, or Firm*—Alston & Bird LLP

[57] ABSTRACT

A method and an apparatus for spinning, drawing, and winding a synthetic filament yarn, wherein a plurality of filaments are combined in a spin zone to a yarn. Subsequently, the yarn is drawn in a draw zone which includes a draw godet, and then wound in a takeup zone to form a package. To produce a cohesion of the yarn, the filaments are entangled within the draw zone before the yarn leaves the draw godet.

21 Claims, 4 Drawing Sheets

METHOD AND APPARATUS FOR SPINNING, DRAWING, AND WINDING A YARN

BACKGROUND OF THE INVENTION

The present invention relates to a method and apparatus for spinning, drawing, and winding a synthetic multifilament yarn. A method and apparatus of this general type is known from DE 31 46 054. In this known method and apparatus, a fully drawn multifilament yarn is entangled in an entanglement nozzle directly upstream of the winder. The entanglement upstream of the winder serves to produce the necessary yarn cohesion for the further processing of the yarn.

The known method and the known apparatus have the disadvantage that during the winding of the yarn, the yarn tension is dependent on the entanglement, and that it is necessary to wind the yarn at a relatively high yarn tension level. However, this results in that the packages tend to bulge considerably, so that it is possible to wind only packages with a small diameter.

U.S. Pat. No. 4,228,120 discloses a method and an apparatus, wherein a driven roll is arranged between the winder and the entanglement nozzle. In this connection, the use of an additional subassembly achieves the result that the yarn tension is adjustable prior to the takeup. The introduction of an additional subassembly requires a further deflection of the yarn, which leads to a more complex yarn path as well as to a generally higher level of the yarn tension.

It is accordingly an object of the present invention to further develop a method and an apparatus of the initially described type such that a yarn entangled upstream of the winder can be wound under an adjustable yarn tension requiring the least possible amount of apparatus.

SUMMARY OF THE INVENTION

The above and other objects and advantages of the present invention are achieved by the provision of a melt spinning method and apparatus which involves extruding a polymeric melt to form a plurality of advancing filaments which are then gathered together to form an advancing yarn, and then applying a drawing force to the advancing filaments in a draw zone and so as to draw the advancing yarn. Also, the filaments of the advancing yarn are entangled while the yarn is advancing through the draw zone, and the yarn is then wound into a package.

Preferably, the drawing zone includes a final draw unit which comprises a draw godet and a guide roll, and the draw unit is positioned so that the advancing yarn loops several times thereabout. Also, the entangling of the filaments is accomplished by an entangling nozzle positioned preferably in the final loop of the yarn about the draw unit.

An important feature of the invention lies in the fact that the yarn tension for winding the yarn is adjustable by the draw godet of a draw unit. It has come as a surprise that despite the relatively high level of the yarn tension in the draw zone, it is possible to realize adequately high yarn cohesion by entangling the filaments. Since the knot frequency is inversely proportional to the yarn tension, it is advantageous to entangle the yarn shortly before it leaves the draw zone, i.e., shortly before the yarn leaves the last draw godet. Furthermore, the invention has the advantage that the spacing between the draw zone or draw system and the winder or takeup system may be kept short, so that no significant changes in the yarn tension can develop by air frictions on the yarn.

To realize entanglement in a least possible tensioned state of the yarn, it is desirable to entangle the yarn during its final looping about the draw unit and at a location between the draw godet and the guide roll. With the use of a draw godet unit that is looped by the yarn several times, the yarn tension continuously decreases from the point of contact of the yarn on the draw godet to the point of departure of the yarn from the draw godet. Thus, the lowest level of the yarn tension in the draw zone is reached in the final looping. Therefore, an entanglement of the yarn in the length of the final looping before the yarn leaves the draw godet, will lead to increased yarn cohesion.

A particularly advantageous further development of the invention provides that the yarn is entangled in the entanglement nozzle by an air stream oriented in the direction of the advancing yarn. This imparts to the yarn an advancing component by the entanglement nozzle. This effect favors the smooth run of the yarn.

In a further, particularly advantageous embodiment of the invention, the yarn is entangled in a heated condition. With that, it is possible to realize a further increase in the number of knots in the yarn, since the heated filaments exhibit a higher elasticity and, thus, a higher tendency to entangling. The heating of the filaments may occur in this process by means of a heating device or directly by a heated godet.

However, it is also very advantageous to realize the entanglement with a heated air stream. In this variant of the method, a relaxation occurs at the same time which is further increased by a subsequent heat treatment of the entangled yarn.

A second entanglement nozzle may be positioned to entangle the yarn before it enters the draw zone, and the yarn may be entangled by an air stream that is oppositely directed to the direction of the advancing yarn. This has the advantage that the yarn-braking effect of the entanglement nozzle assists in the looping of the yarn about the guide elements for purposes of a smooth advance of the yarn. As a result, it is likewise possible to keep the looping for guiding the yarn as low as possible.

The method of the present invention can be applied to all common polymer types, such as polyamide, polyester, or polypropylene. In the production of a polyester yarn with a denier of 50 dtex f24, it was possible to decrease the yarn tension upstream of the winder by more than 50% in comparison with the conventional method. A minimal yarn tension of 4 cN was reached upstream of the winder. This method is therefore suitable in particular for yarns with fine deniers, which are wound under the lowest possible tension.

The spinning apparatus of the present invention is characterized in particular in that besides the draw system, no additional driven auxiliary yarn guiding means are needed to guide the yarn to the takeup device. In addition, it is possible to do without an additional suction or an additional heat insulation of the entanglement nozzle by arranging the entanglement nozzle in the draw system. This function is assumed by existing godet boxes of the draw system.

To guide the yarn with several loopings over a draw godet, it is advantageous to use a godet unit. The godet unit may be formed by the draw godet and a guide roll or a second draw godet.

To decrease the yarn tension after the entanglement to a level required for the takeup, the draw godet has a roughness of about 0.1 $\mu$m in a section in which the yarn contacts the godet surface during its final looping. The remaining range of the godet surface, however, has a greater roughness of about 5 $\mu$m.

To further minimize the level of the yarn tension upstream of the takeup, the embodiment of the spinning apparatus is especially advantageous, wherein the draw godet has in a section that is contacted by the yarn during its final looping, a smaller diameter than in the remaining range of the godet. It has shown in this instance that a diameter difference of as small as 0.5% to 1% resulted in a substantial increase of the number of knots in the entangled yarn.

To produce yarn in the fine denier range, the further development of the spinning apparatus will be advantageous, wherein the guide roll or the second godet is likewise driven.

BRIEF DESCRIPTION OF THE DRAWINGS

Some of the objects and advantages of the invention having been stated, others will appear as the description proceeds, when considered in conjunction with the accompanying drawings, in which.

DETAILED DESCRIPTION OF THE PREFERRED EMBODIMENTS

Figure 1:
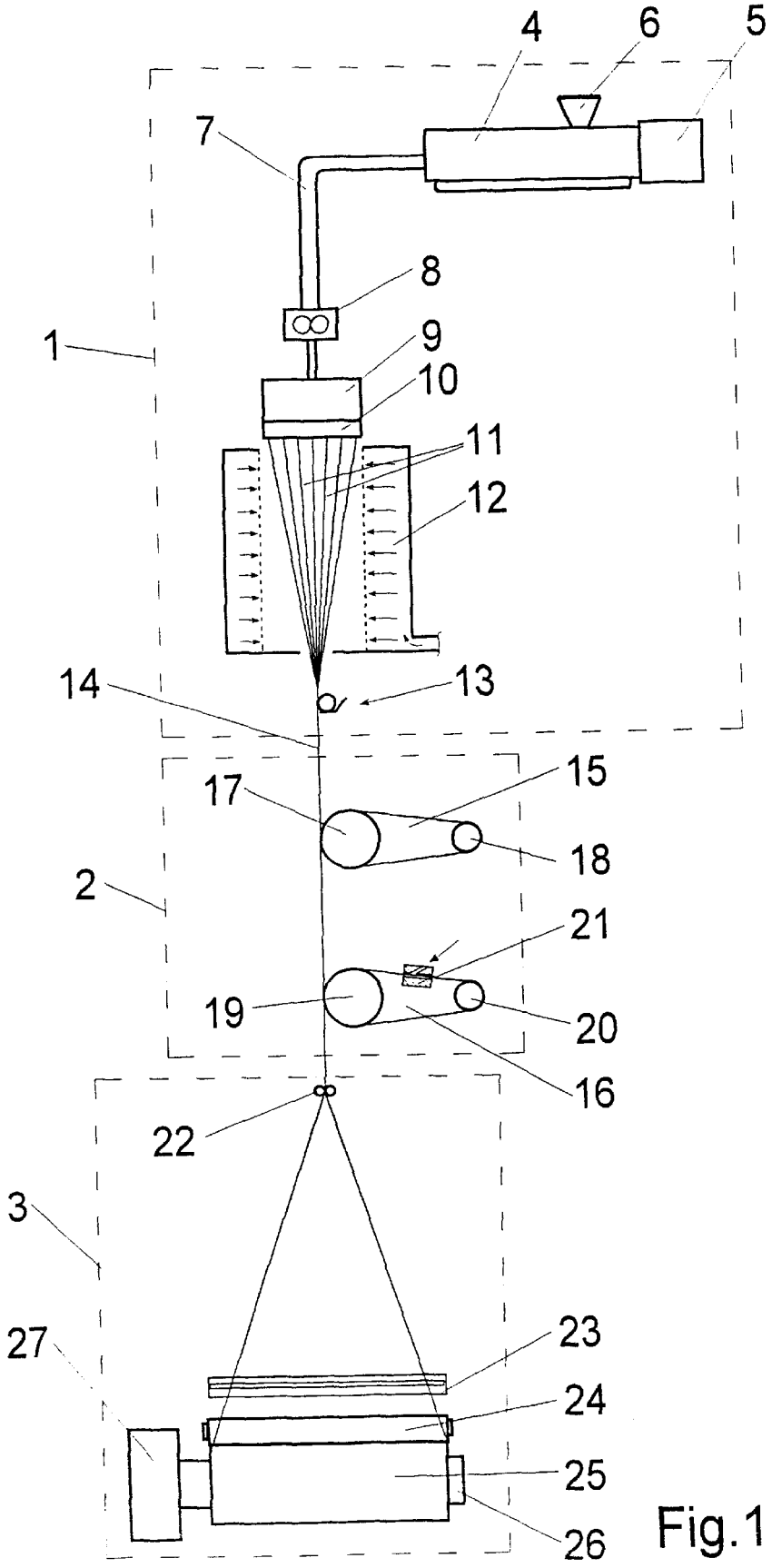
FIG. 1 is a schematic view of a melt spinning method and apparatus according to the invention.

FIG. 1 is a schematic view of a first embodiment of a melt spinning method and apparatus according to the invention. To produce a yarn, the spinning apparatus comprises a spinning system 1, a draw system 2 downstream of spinning system 1, and a takeup system 3 that is intended for winding the yarn.

In the spinning system 1, a yarn 14 is spun from a thermoplastic material. The thermoplastic material is fed through a hopper 6 to an extruder 4 that is driven by a drive 5. In the extruder 4, the thermoplastic material is melted. Through a melt line 7, the melt flow reaches a spin pump 8. The spin pump 8 advances the melt flow to a heated spin head 9. On its underside, the spin head 9 mounts a spinneret 10. From the spinneret 10, the melt emerges in the form of fine filament strands 11. Downstream of the spinneret, the filaments advance through a cooling device 12. In the cooling device 12, an air stream cools the filaments. As shown in FIG. 1, the air stream can be generated by directing air transversely to or radially to the group of filaments or, however, by a suction device arranged at the outlet end of the cooling device. Directly downstream of the cooling device 12, a lubrication device 13 is arranged that combines the filaments to a yarn 14.

From the spin zone, the yarn 14 is withdrawn by draw system 2. To this end, the draw system 2 comprises a first godet unit 15. The godet unit 15 consists of a withdrawal godet 17 and a guide roll 18 arranged with its axis inclined relative to godet 17. The yarn 14 loops about godet 17 several times. The godet 17 is driven by a drive at a preadjustable speed. This withdrawal speed may be by a multiple higher than the natural exit speed of the filaments 11 from the spinneret 10. The guide roll 18 is freely rotatable.

From withdrawal godet 17, the yarn advances to a godet unit 16. The godet unit comprises a draw godet 19 and a guide roll 20. The draw godet 19 is driven at a higher speed than the previously described withdrawal godet 17. As a result, the yarn is drawn between the two godets 17 and 19. The godets 17 and 19 may be heated.

Before leaving the draw zone, the yarn 14 advances through an entanglement nozzle 21 arranged between guide roll 20 and draw godet 19, before it leaves godet 19. In this entanglement nozzle, an air stream entangles the filaments of yarn 14. With that, a so-called yarn cohesion is produced, which is necessary for further processing in subsequent processes.

From the draw zone, the yarn 14 is withdrawn by means of takeup system 3, and it advances via a yarn guide 22 into a takeup zone. From yarn guide 22, the yarn 14 enters into a traversing triangle and a traversing device 23 arranged at the end of the traversing triangle. The traversing device may be of the rotary blade type, or it may be realized by a cross-spiraled roll. In both cases, traversing yarn guides reciprocate the yarn 14 within a traverse stroke. In so doing, the yarn loops about a contact roll 24 downstream of the traversing device. The contact roll 24 lies against the surface of a package 25. It serves to measure the surface speed of package 25. The package 25 is wound on a tube that is mounted on a winding spindle 26. A spindle motor 27 drives the winding spindle 26. The spindle motor 27 is controlled in such a manner that the surface speed of the package 25 remains constant. To this end, the rotational speed of freely rotatable contact roll 24 is sensed for use as a controlled variable.

The spinning apparatus as shown in FIG. 1 is especially suited for producing fully drawn yarns. In this apparatus, the arrangement of the entanglement nozzle within the draw zone permits advantageous adjustment of the yarn tension for winding the yarn by means of the godet upstream of the takeup zone. In this connection, it will be especially advantageous to arrange the entanglement nozzle 21—as shown in FIG. 2—in the last looping between godet 19 and guide roll 20.

Figure 2:
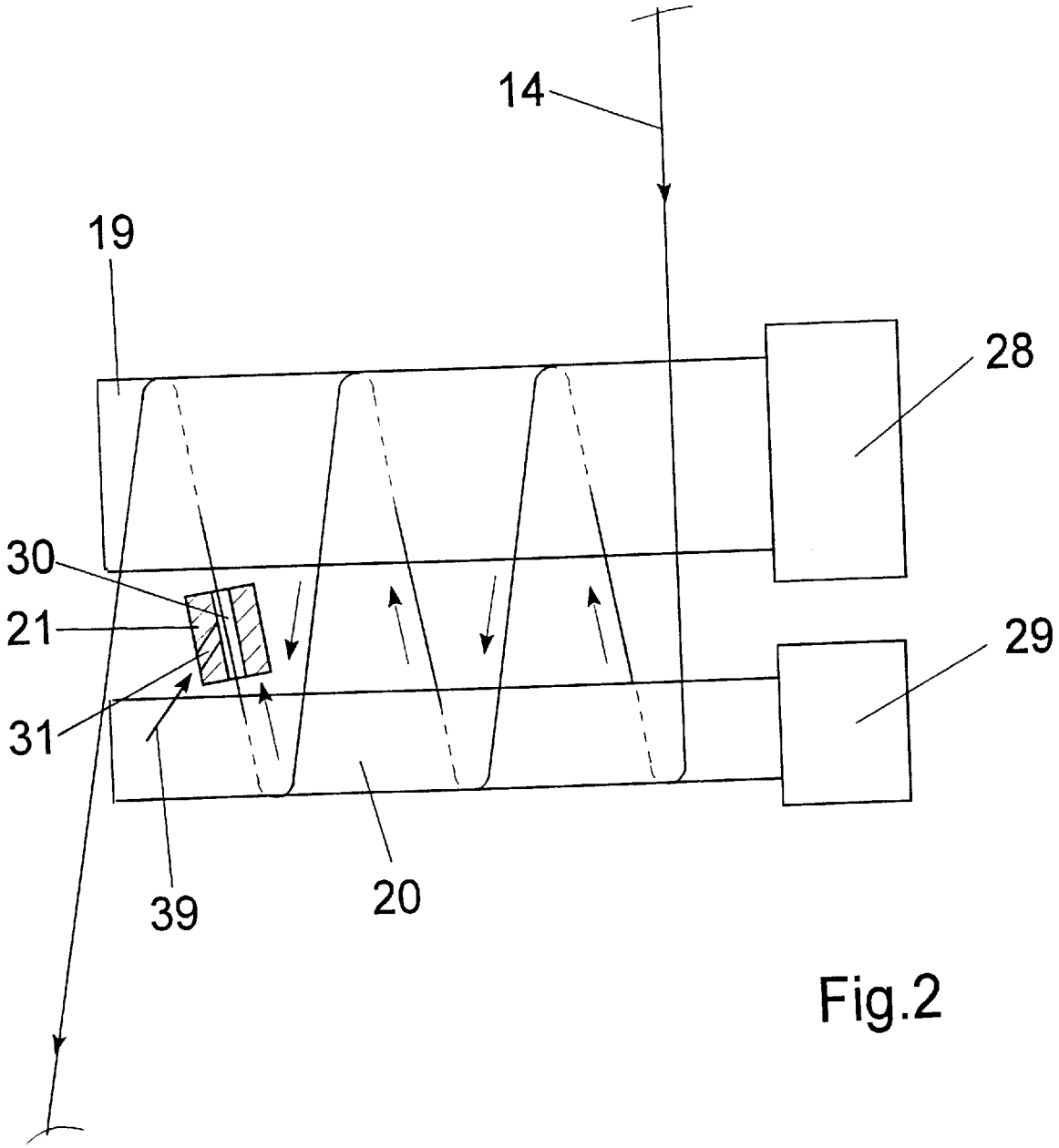
FIG. 2 is a schematic view of the godet unit of the spinning apparatus of FIG. 1.

FIG. 2 is a schematic side view of the godet unit 16 of FIG. 1. The godet unit comprises draw godet 19 that connects at its one end to a godet drive 28. Arranged in spaced relation to godet 19 is guide roll 20 that is supported at its one end for free rotation in a bearing block 29. In comparison with the situation shown in FIG. 1, FIG. 2 shows the path of the yarn toward the draw godet and away therefrom rotated by 90°. In this instance, the yarn previously heated by godet 17 advances onto godet 19. The godet 19 is likewise heated. From godet 19, the yarn 14 advances to guide roll 20, and from guide roll 20 back to godet 19. The yarn 14 performs this looping several times. In so doing, it is heated by the heated jacket of godet 19. In the last looping between guide roll 20 and godet 19, the entanglement nozzle 21 is arranged in the path of the yarn. The entanglement nozzle 21 has a yarn channel 30 through which the yarn advances. In yarn channel 30, an air channel 31 terminates, so that the yarn is contacted by an air current 39 introduced through air channel 31 that is oriented in the direction of the yarn path. By the inflowing air stream, the filaments of the yarn 14 are entangled, and individual, so-called knots form in the yarn. As a result of heat treating the yarn, it is possible to increase the number of knots per length unit. A subsequent, short heat treatment after the entanglement, leads in addition to a setting of the knots and, thus, to a stable yarn cohesion.

The orientation of the air channel 31 in the direction of the advancing yarn results in that the inflowing air generates in the direction of the advancing yarn frictional forces that cause a tension on the yarn in its direction of advance. With that, the yarn tension for drawing is maintained or supported. The yarn tension additionally applied to the yarn by the entanglement may, however, be again decreased by the godet, advantageously by means of looping the yarn about godet 19, so that the yarn can be wound at a relatively low tension level.

To further increase the number of knots during the entanglement, it is possible to heat the air before supplying same to the entanglement nozzle 21. The spinning apparatus and the method of the present invention permit producing multifilament yarns with a very high cohesion at a low yarn tension and to wind same to packages. Therefore, the method is also well suited for yarns with fine deniers.

Figure 3:
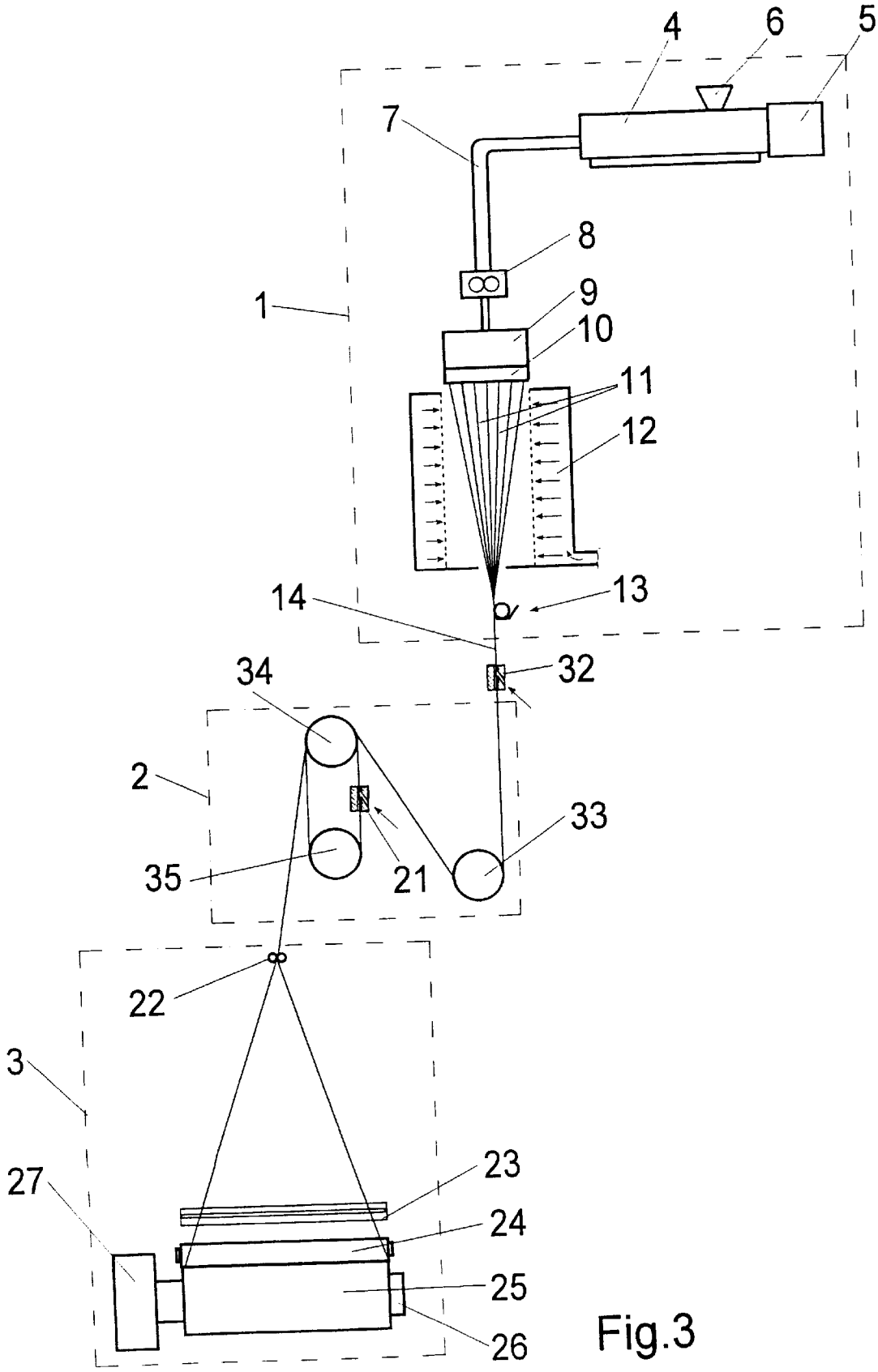
FIG. 3 is a schematic view of a further embodiment of a spinning method and apparatus according to the invention.

FIG. 3 shows a further embodiment of a spinning apparatus according to the invention. The spinning system 1 and takeup system 3 as shown in FIG. 3 are identical with the spinning system and takeup system of FIG. 1. To this end, the description of FIG. 1 is herewith incorporated by reference.

In the spinning system of FIG. 3, the draw system 2 comprises a withdrawal godet 33. This godet withdraws the yarn 14 from the spin zone. From withdrawal godet 33, the yarn advances to a godet unit that is formed by draw godets 34 and 35. The yarn loops about godets 34 and 35 several times. After leaving godet 34, the yarn 14 is withdrawn from the draw zone by the takeup system 3. Before the withdrawal, an entanglement nozzle 21 arranged between godet 34 and godet 35 entangles the yarn. The layout of the entanglement nozzle 21 corresponds to the entanglement nozzle described above with reference to FIG. 2. To this extent, the description of FIG. 2 is herewith incorporated by reference.

In the spinning apparatus shown in FIG. 3, the yarn 14 undergoes an initial entangling in an entanglement nozzle 32 before advancing into the draw zone. The entanglement nozzle 32 is designed and constructed such that an air stream flowing in opposite direction to the advancing yarn is used to entangle the yarn. As a result, a braking effect occurs on yarn 14. It is therefore possible to withdraw the yarn 14 by a single looping about godet 33. The preliminary entanglement of the yarn has in addition the advantage that it is possible to stabilize the guidance of the yarn, and to realize a smooth, uniform advance of the yarn even with little loopings about the yarn guide elements.

The draw godets 34 and 35 are heated, so that entanglement occurs likewise on a heated yarn.

Figure 4:
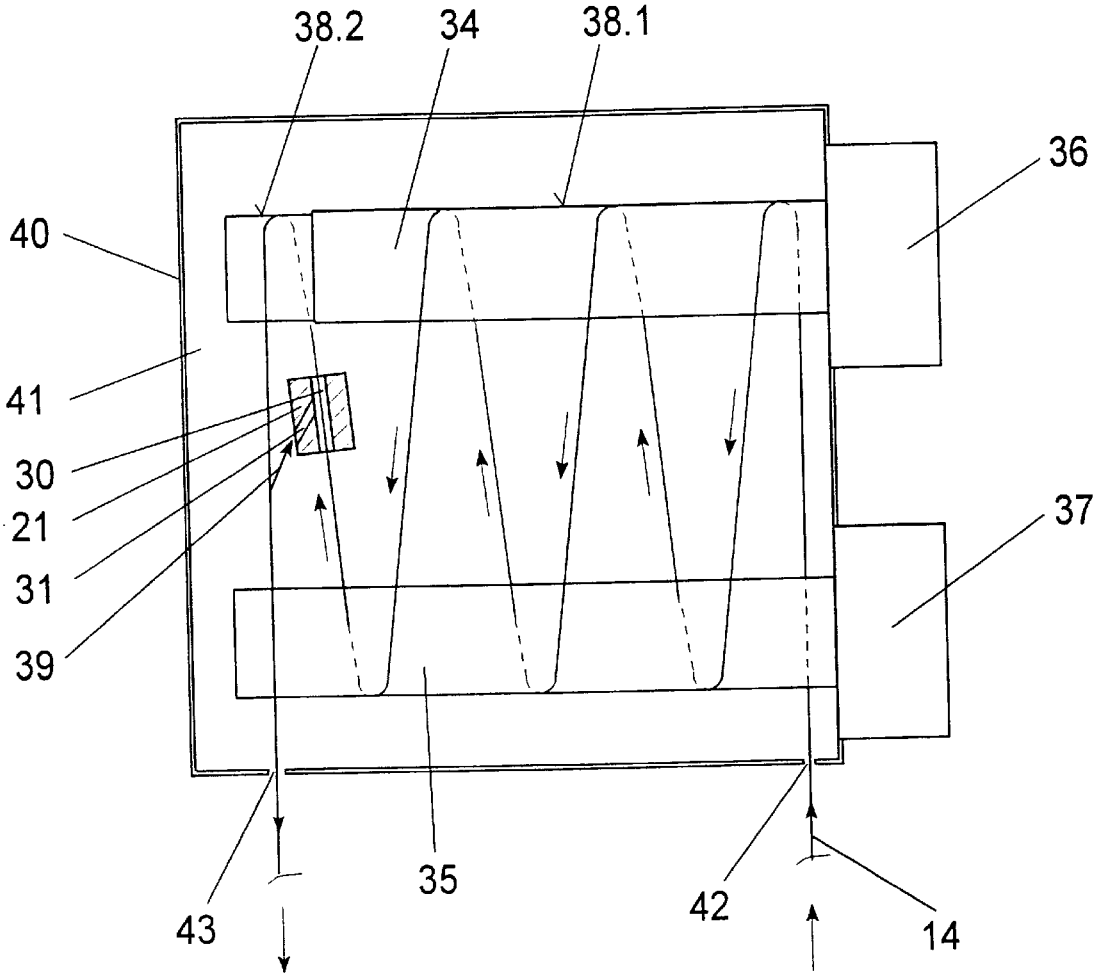
FIG. 4 is a schematic view of a further embodiment of a godet unit.

To achieve a uniform heating of the yarn, FIG. 4 illustrates a godet unit that is arranged inside a heating chamber. The heating chamber 41 is formed by a box 40 that accommodates draw godets 34 and 35. A drive 36 of godet 34 and a drive 37 of godet 35 are arranged outside of the heating chamber. The yarn 14 enters the heating chamber through an inlet opening 42 and advances onto godet 34. From this godet, the yarn then advances to the second godet 35 arranged in spaced relationship therewith. The yarn repeats this looping several times, until it exits, after leaving godet 34, through an outlet opening 43.

In the godet unit shown in FIG. 4, the jacket surface of godet 34 is divided into two sections 38.1 and 38.2. The jacket surface 38.1 has a somewhat larger diameter than the section 38.2. The section 38.2 of the godet surface with the smaller diameter is contacted by yarn 14 during its final looping. As a result of this diameter step in godet 34, it is accomplished that entanglement of the yarn in the preceding entanglement nozzle 21 can be performed at a lower yarn tension level. This permits increasing the knots in the yarn, since—as is known—the number of knots per length unit in the yarn is inversely proportional to the yarn tension. In this embodiment, the entanglement nozzle 21 is again arranged in the final looping of the yarn upstream of godet 34. As regards its function, the description of FIG. 2 is herewith incorporated by reference.

In all previously shown embodiments, the godet upstream of the takeup has such a surface finish that in the region of the final looping, the godet is able to absorb the yarn tension increase resulting from the entanglement. The method of the present invention was able to facilitate an adequate adjustability of the yarn tension prior to the takeup with roughness in this region of the surface on the order of about 0.1 $\mu$m. In comparison therewith, the godet had a roughness of about 0.5 $\mu$m in its remaining surface region.

The method of the present invention is not limited to the illustrated spinning apparatus. The draw systems shown in FIGS. 1 and 3 are exemplary. Upstream of the last godet of the draw unit, it is also possible to arrange heating devices for hot treating the yarn or, however, downstream thereof, even heating devices for relaxing the yarn. Likewise, the arrangement of the entanglement nozzle upstream of the draw godet is flexible, i.e., it would also be possible to arrange the entanglement nozzle in a different branch of the looping.

The spinning apparatus of the present invention distinguish themselves by their compact construction and the short yarn path between the draw unit and the takeup. An additional deflection or an additional driven godet between the draw unit and the takeup system is not needed. A further advantage lies in that the entanglement nozzles may also be arranged in the godet boxes, so that a separate insulation against loss of heat as well as a separate suction for the entanglement nozzle are unnecessary, since these functions are met by the godet box.

That which is claimed is:

1. A method of spinning a synthetic multi-filament yarn comprising the steps of extruding a polymeric melt to form a plurality of advancing filaments and gathering the filaments to form an advancing yarn, applying a drawing force to the advancing yarn in a draw zone and so as to draw the advancing yarn, entangling the filaments of the advancing yarn while the yarn is within the draw zone, and then winding the advancing yarn into a package.

2. The yarn spinning method as defined in claim 1 wherein the step of applying a drawing force to the advancing yarn includes looping the advancing yarn several times about a godet unit which comprises a draw godet and a guide roll, and wherein the filament entangling step occurs prior to the advancing yarn leaving the godet unit.

3. The yarn spinning method as defined in claim 2 wherein the entangling step occurs during the final looping of the advancing yarn about the godet unit and at a location between the draw godet and the guide roll.

4. The yarn spinning method as defined in claim 3 wherein the entangling step includes passing the advancing yarn through a nozzle while directing an air stream into contact with the advancing yarn in the nozzle.

5. The yarn spinning method as defined in claim 2, comprising the further step of heating the advancing yarn just before the entangling step.

6. The yarn spinning method as defined in claim 5 wherein the heating step includes heating the draw godet.

7. The yarn spinning method as defined in claim 1 wherein the filament entangling step includes applying a heated air stream to the advancing yarn.

8. The yarn spinning method as defined in claim 1 comprising the further step of entangling the filaments of the advancing yarn prior to the advancing yarn entering the draw zone.

9. The yarn spinning method as defined in claim 1 wherein the filament entangling step includes directing an air stream into contact with the advancing yarn, with the air stream having a directional component which is opposite to the direction of the advancing yarn.

10. An apparatus for spinning a synthetic multi-filament yarn comprising an extruder for extruding a polymeric melt through a spinneret to form a plurality of advancing filaments, a guide for gathering the advancing filaments to form an advancing yarn, means for drawing the advancing yarn and so as to define a drawing zone, an entanglement nozzle positioned within the drawing zone for entangling the filaments of the advancing yarn, and a winder positioned downstream of the drawing zone for winding the advancing yarn into a package.

11. The yarn spinning apparatus as defined in claim 10 wherein the drawing means includes a godet unit which comprises a draw godet and a guide roll and which is positioned so that the advancing yarn is looped several times thereabout.

12. The yarn spinning apparatus as defined in claim 11 wherein the entanglement nozzle is positioned in the path of the looping yarn between the draw godet and the guide roll.

13. The yarn spinning apparatus as defined in claim 12 wherein the entanglement nozzle is positioned in the path of the final loop of the advancing yarn between the draw godet and the guide roll.

14. The yarn spinning apparatus as defined in claim 12 wherein the draw godet has a first outer surface portion which is contacted by the initial loops of the advancing yarn and a second outer surface portion which is contacted by the final loops of the advancing yarn.

15. The yarn spinning apparatus as defined in claim 14 wherein the second outer surface portion is less rough than the roughness of the first outer surface portion.

16. The yarn spinning apparatus as defined in claim 14 wherein the diameter of the second outer surface portion is less than the diameter of the first outer surface portion.

17. The yarn spinning apparatus as defined in claim 10 wherein the entanglement nozzle comprises a yarn channel for receiving the advancing yarn, and an air channel communicating with the yarn channel for directing an air stream into contact with the advancing yarn as it advances through the yarn channel.

18. The yarn spinning apparatus as defined in claim 17 wherein the yarn channel and the air channel form an acute angle and so that the air stream has a directional component opposite the direction of the advancing yarn.

19. The yarn spinning apparatus as defined in claim 11 further comprising heating means for the godet unit so as to heat the advancing yarn.

20. The yarn spinning apparatus as defined in claim 11 further comprising a separate drive for the draw godet and the guide roll of the godet unit.

21. The yarn spinning apparatus as defined in claim 10 further comprising a second entanglement nozzle positioned in the path of the advancing yarn between the filament gathering guide and the draw zone.

* * * * *